US010551147B1

(12) United States Patent
Follansbee et al.

(10) Patent No.: US 10,551,147 B1
(45) Date of Patent: Feb. 4, 2020

(54) MULTI-BARREL MORTAR LAUNCHER AND METHOD

(71) Applicant: CRUSADE WEAPONS DEVELOPMENT, LLC, Manchester, NH (US)

(72) Inventors: Joe R. Follansbee, Nottingham, NH (US); Robert M. Kelly, Jr., Manchester, NH (US)

(73) Assignee: COMBAT WEAPONS DEVELOPMENT LLC, Manchester, NH (US)

( * ) Notice: Subject to any disclaimer, the term of this patent is extended or adjusted under 35 U.S.C. 154(b) by 0 days.

(21) Appl. No.: 15/934,924

(22) Filed: Mar. 23, 2018

Related U.S. Application Data

(60) Provisional application No. 62/475,249, filed on Mar. 23, 2017.

(51) Int. Cl.
*F41F 1/08* (2006.01)
*F41A 23/54* (2006.01)
*F41F 1/06* (2006.01)

(52) U.S. Cl.
CPC ..... *F41F 1/08* (2013.01); *F41A 23/54* (2013.01); *F41F 1/06* (2013.01)

(58) Field of Classification Search
CPC ..... F41A 23/54
USPC ..... 89/1.41
See application file for complete search history.

(56) References Cited

U.S. PATENT DOCUMENTS

| | | | | | |
|---|---|---|---|---|---|
| 3,643,545 | A * | 2/1972 | Nahas | F41F 7/00 | 102/530 |
| 3,710,675 | A * | 1/1973 | Asikainen | F41F 1/06 | 89/200 |
| 4,233,882 | A * | 11/1980 | Eichweber | F41A 19/58 | 102/480 |
| 5,269,214 | A * | 12/1993 | Badura | F41F 1/08 | 42/105 |
| 5,429,053 | A * | 7/1995 | Walker | F42B 4/20 | 102/342 |
| 5,452,640 | A * | 9/1995 | Bovee | F41F 1/08 | 89/1.815 |
| 7,007,584 | B2 * | 3/2006 | Caballer Barat | F42B 3/26 | 102/343 |
| 8,490,532 | B2 * | 7/2013 | Barlow | F41A 23/24 | 89/1.41 |
| 8,536,500 | B2 * | 9/2013 | Glasson | F41A 27/22 | 244/3.1 |
| 9,074,843 | B1 * | 7/2015 | Montgomery | F41F 1/06 | |
| 2001/0015126 | A1 * | 8/2001 | Grunewald | F41A 27/08 | 89/1.41 |
| 2008/0006168 | A1 * | 1/2008 | Huang | F42B 4/20 | 102/358 |

* cited by examiner

*Primary Examiner* — Samir Abdosh

(57) ABSTRACT

A multi-barrel mortar launcher with an array of barrels and a fire control mechanism, where the array is configured to fire one mortar round from each barrel with substantially the same time-on-target in an impact area having an array of blast radii corresponding to the array of barrels.

18 Claims, 12 Drawing Sheets

Time on Target Impact

Time on Target Impact

MULTI-BARREL MORTAR LAUNCHER AND METHOD

RELATED APPLICATION

This application claims the benefit of provisional patent application No. 62/475,249, filed on Mar. 23, 2017, and titled 'MULTI-BARREL MORTAR SYSTEM AND METHOD", the contents of which are incorporated by reference in their entirety.

BACKGROUND OF THE INVENTION

1. Field of the Invention

The present invention relates generally to mortar launchers and more particularly to a multi-barrel mortar launcher and method of use.

2. Description of the Prior Art

Military forces have traditionally used a combination of handguns, rifles, hand grenades, shoulder-mounted rocket launchers, single-shot mortars, anti-aircraft missiles, tanks, armored vehicles, bombs, and other munitions for defense and military operations.

SUMMARY OF THE INVENTION

Ground combat is principally characterized by close proximity, extreme violence, and surprise. Despite advances in technology, ground combat operations remain, and likely will continue to be, a close fight. "The Last Hundred Yards" is a phrase in the lexicon of many combat leaders. Adaptive adversaries for decades have strategized to offset US technological and air superiority dominance by "hugging" our forces, i.e., getting closer than air support and artillery optimally can be employed. Weapons and explosives used in battles with distances up to 1000 meters include rifles and other small arms. Each weapon has its own effective range and lethality. Hand grenades, pistols, and claymore mines are suited for a range of less than 50 meters. Rifles and other small arms have maximum effective ranges of 300 to 1000 meters, depending on the configuration. However, a need exists for more lethal firepower for the close fight, namely, under 300 meters.

Conventional U.S. military superiority makes it unlikely that our future enemies will present themselves for destruction in a single, decisive battle. Instead, they will disperse and apply deception and denial techniques that mitigate easy identification and targeting. They will use crude but effective decoys to deceive overhead intelligence collection systems. They will disperse their assets and shield vulnerabilities by mixing with civilians and operating in complex terrain. Future enemies realize that since they cannot win conventionally, they must rely on a denial strategy that hopes to elongate conflicts, erode American influence, and weaken our will.

The future enemies additionally will seek to occasionally concentrate or surge large combat forces to overwhelm smaller U.S. forces in an effort to create massacres that erode the will of the American people. Successful adaptation by U.S. military forces must continually evolve to render these denial strategies ineffective.

The combination of the inherent complexity of mixed terrain, foreign cultures, and future adaptive adversaries will generate new operational challenges for all forward deployed combat forces. Future conflicts caused by unrest, ethnic tension, and despair will increasingly occur in the chaotic conditions of this complex and dense environment.

The complexity of the emerging environment has led to a corresponding decision by U.S. forces to improve their capacity to conduct decentralized and nonlinear operations in complex terrain such as littorals, deserts, jungles, cities and mountainous areas. U.S. forces are adopting distributed operations to achieve the high degree of operational tempo and fluidity inherent to maneuver warfare, and this means in simple terms, more small groups of Americans in small combat outposts, than ever before.

The U.S. military is reducing the size of the independent fighting unit to squad and platoon levels, and is using enhanced and fully-exploited technology and weaponry, as well as tactics, training, and procedures to make this ongoing change survivable. These operations give commanders the ability to influence a much greater area of the battlespace, both in depth and breadth, than can be accomplished with more traditional conventional operations. Distributed operations expand commanders' capability to influence and shape the battlespace across a range of military operations.

Distributed operations are characterized by the physical dispersion of networked units over an extended battlespace. Battalion-sized to squad-sized formations can conduct such operations. These operations avoid linear, sequential, and predictable operations. They afford the commander a means for addressing ambiguity and uncertainty in the battlespace environment. Distributed forces present a complex puzzle to the adversary. Their relative mobility, situational awareness, and modular structure enable rapid adaptation and self-organization, presenting the opponent with a greater degree of uncertainty regarding our locations, intentions, and objectives. Further, as distributed forces develop increasing levels of populace support, it enhances their effectiveness substantially and increasingly challenges our adversary's. This designed challenge and complexity induces confusion and ambiguity and produces a competitive advantage for our forces.

In both Iraq and Afghanistan, for example, pushing combat troops out of concentration from large forward operation bases and into community-based combat outposts was solidly successful for holding areas cleared of enemy forces. The role of U.S. Combat forces in "winning the hearts and minds" of the local inhabitants was a key factor in counter-insurgency. This strategy was successfully used by the 10th Mountain Division warriors in Wardak province in Afghanistan, one of the country's most dangerous valleys, to squash enemy activity and substantially stabilize the region.

Experience gained in military operations worldwide shows that infantry units, Special Operations Forces (SOFs) and other troops that fight on foot require a highly effective organic indirect fire capability. Traditionally, mortars are muzzle-loaded into a smooth-bore tube and fired at a high angle for long-range indirect fire support to light infantry, air assault, and airborne units across the entire front of a battalion zone of influence.

One approach to improvements in mortar launchers is a multi-barrel mortar as disclosed in disclosed in Korean patent publication no. 1020140089619A to Dong Sun Kim. The multi-barrel mortar launcher includes a base and a plurality of barrels connected to a barrel fixing plate. The mortar includes an altitude control attached between the base plate and the fixing plate. Each barrel is oriented parallel to a single central axis and adjacent barrels are spaced by a consistent gap. The frame is connected to the lower part of the barrel and trunnion. The altitude and point of aim can be adjusted for the barrels as a group.

Another approach of the prior art is known as the Fly-K by Rheinmetall. The Fly-K is a stealth 40-mm "grenade mortar" system for mobile infantry units. The Fly-K operates with a closed-combustion chamber and is touted as being nearly silent since the expanded propellant gases are contained rather than allowed to escape. The Fly-K is also touted as having no muzzle flash, no smoke, and no thermal signature. The Fly-K uses twelve spigots, one for each of twelve 40-mm mortar rounds fired in rapid succession. A digital aiming unit measures the incline and elevation angle of the Fly-K unit and then aims the unit to fire mortars at targets from 200 to 800 meters away. The closed-combustion chamber does not allow for auxiliary propellant charges and therefore is impractical for larger mortars, which derive their utility in great part from the variable number of propellant charges.

Some existing mortar systems use proprietary or non-standard ammunition (e.g., 40-mm grenade mortar rounds). Also, existing multi-barrel mortar systems also are not self-contained and have multiple individual components. Further, these mortar systems are highly complex, therefore requiring extensive training to correctly implement range parameters and to insure friendly fire incidents do not occur. Still further, existing mortar systems provide only a single point of aim that applies to all mortar rounds. To impact a different target, the aim of the unit as a whole must be changed.

When combat power is intentionally diffused through distributed operations, commanders at all levels need to fortify isolated units in remote locations by increasing their organic lethality. To address that need, mortar systems in accordance with the present disclosure provide massive firepower to this close fight, in an unprecedented, simple, and effective manner. The present disclosure is a short launch, anti-personnel multi-mortar enemy repeller, or "SLAMMER." SLAMMER increases the final protective-fire lethality of ground forces, therefore increasing survival chances in close combat and ambush situations, for example. Beyond distributed operations, SLAMMER is synergistically powerful in both offensive and defense operations in high, medium, and low intensity conflicts, and further is highly applicable for special operations missions.

In contrast to the prior-art mortar systems, SLAMMER is simpler, more lethal, and uses commonly-available/standard mortar ammunition (e.g., 60-mm and 81-mm mortar rounds). In some embodiments, SLAMMER fires mortars at charge zero, the lowest level of firing charge, to enable close-range use, such as from 0 to 400 meters from the launcher. Due to its lethality at relatively short range, SLAMMER fills an unmet need for defensive and offensive military operations.

As a result of distributed operations and the ongoing refinement of this methodology, small groups of combat soldiers, ranging from 11 to 40 in size, will increasingly be placed in harm's way. In many cases, these small groups of soldiers will have great distances between them, such that the groups are outside of conventional artillery or mortar range. As a result, the groups will require Close Air Support (CAS) as a principal response to large scale attacks; however, this air support is sometimes not available for a variety of reasons. SLAMMER provides mortar lethality to the close fight in a simple and deadly unit. Regardless of what fire support is available, some embodiments of SLAMMER provide a localized, final protective fire augmentation that is substantial, lethal, simple, and instant on demand, making SLAMMER the greatest close combat innovation in a very long time for squad-level and platoon-level warfare, where wars are fought and won.

In future operations, Commanders utilizing SLAMMER will be able to intelligently augment select small combat outposts, and those units will have greater likelihood of survival when attacked by larger forces. SLAMMER will be used in securing logistics bases, headquarters, airfields, ports, and other critical locations. SLAMMER can contribute to security for ground transportation "bubbles" during movement and can be fully integrated with historic fire support and close-air support methods supporting logistics convoys.

SLAMMER is not intended to change nor eliminate a single current fielded weapon system in either the USMC nor US Army combat units, but instead it is intended to enhance all of them. SLAMMER does not reduce the value or need of traditional artillery, mortar, or close air support on the battlefield. Instead, SLAMMER greatly adds to traditional artillery and the like by enabling squads and platoons direct control of massive firepower at close ranges, when such operations both need and deserve the firepower. For example, senior commanders can heavily augment units with SLAMMER when necessary, creating substantial time for quick reactionary forces to relieve beleaguered small units. A conventional mortar is fired using a six-person team, each of whom has undergone significant training to align the elevation angle and azimuth angle of the barrel so that the shell explodes in a predefined location. In some embodiments, SLAMMER is a point-and-shoot system requiring minimal training that delivers mortar shell explosions in predefined locations.

When it comes to the critical distributed operations or conventional phase of dominating the enemy, offensive combat operations equipped with SLAMMER can bring more instant lethal firepower to the close fight than any current system, enabling more lethal squad and platoon operations than has ever been possible. To simplify its training requirements and use, some embodiments of SLAMMER fire existing and proven mortar rounds using the lowest charge zero, and therefore that are useful for the close fight (under 300 meters). SLAMMER also can provide instant fire support to engaged combat forces to enforce perimeter final protective fires. In some embodiments, SLAMMER can be mounted on vehicles to enhance their response options to close combat in offensive, defensive, and logistics operations. For example, SLAMMER can be mounted to Humvees, tanks, sea craft, wheeled transport carts, and armored vehicles, to name a few examples.

In one embodiment, a multi-barrel mortar unit ("SLAMMER") has a plurality of launch tubes or barrels arranged in a barrel array that is attached to a base, such as a box enclosure. Each barrel of the barrel array has its own elevation and azimuth angles. The multi-barrel unit is configured to provide substantially the same time-on-target impact for mortar rounds fired from each of the barrels in the barrel array, where the blast radii of the fired mortars are similarly distributed in a blast array that defines a kill zone of about 100 m×100 m, for example. Embodiments of SLAMMER may be configured for an impact area at long range (e.g., 270-370 meters), medium range (e.g., 170-270 meters), or short range (e.g., 70-170 meters) from the launch unit. In example embodiments, SLAMMER has 16 barrels configured to fire 60-mm mortar rounds, or 9 barrels configured to fire 81-mm mortar rounds. Smaller or larger groups of barrels are also contemplated. In one embodiment, each barrel has the same length of from 16 to 20 inches.

Barrel length may be longer or shorter, such as having a length of 15, 16, 17 18, 20, 22, 24, 26, 28, 30, 32, 34, or 36 inches, for example. In one embodiment, all of the barrels in the barrel array have the same barrel length. In other embodiments, barrels of a single SLAMMER unit may have different barrel lengths, such as a combination of 16 inch, 18 inch, and 20 inch barrels, as will be appreciated.

In another aspect of the invention, a mortar system includes a plurality of multi-barrel mortar units (i.e., multiple "SLAMMER" units). In some embodiments, one or more multi-mortar SLAMMER unit is used by itself. In another embodiment, multiple units are used together in a group, but with individual operation. In yet another embodiment, a plurality of SLAMMER units are used together in coordinated operation.

In another embodiment, a multi-barrel mortar system includes an enclosure with an open top, an array of mortar barrels disposed in the enclosure and arranged such that each barrel has a distinct point of aim. For example, each mortar barrel has an open distal end directed out of the open top of the enclosure and a proximal end adjacent the base of the enclosure and including the necessary fire control mechanism. Each of the plurality of barrels has an elevation angle and an azimuth angle configured to result in an impact area defined by an array of blast radii for a mortar from each corresponding barrel in the barrel array. A firing control mechanism is operatively connected to the proximal end of each barrel and configured to launch a mortar from each of the plurality of mortar barrels. The firing control mechanism fires a mortar from each of the mortar barrels to result in an array of blast radii having substantially the same time-on-target. Mortars launched from each of the plurality of mortar barrels results in a kill zone defined by the array of blast radii in the impact area with substantially the same time-on-target. In one embodiment, the kill zone is 100 meters by 100 meters. In another embodiment, the kill zone has a maximum range less than 400 meters. In another embodiment, the kill zone is 50 meters to 150 meters from the enclosure. In another embodiment, the kill zone is 70 to 170 meters from the enclosure. In another embodiment, the kill zone is 150 to 250 meters from the enclosure. In yet another embodiment, the kill zone is 170 to 270 meters from the enclosure.

Another aspect of the present invention is directed to a method of mortar defense comprising the steps of providing a multi-barrel mortar that includes an enclosure, a plurality of mortar barrels arranged in a barrel array having a front row and a back row, each mortar barrel having an open distal end and a proximal end with an ignition device. The plurality of mortar barrels are secured to each other and retained in the enclosure, where each of the plurality of barrels has a pre-defined elevation angle and a pre-defined azimuth angle configured to provide an impact area with an array of blasts corresponding to the plurality of barrels. One mortar round is configured to be disposed in each of the plurality of mortar barrels. A firing control mechanism is configured to launch one mortar round from each of the plurality of mortar barrels, where the firing control mechanism is configured to fire mortar rounds from each mortar barrel in the barrel array and provide substantially the same time-on-target for each mortar round fired from the plurality of mortar barrels. The plurality of mortar barrels define an impact area based on the predefined combination of elevation and azimuth angles of each barrel in the barrel array. The method also includes the step of causing a mortar to launch from each barrel of the multi-barrel mortar, thereby resulting in an array of blast radii corresponding to the barrel array and having substantially the same time-on-target.

In one embodiment, SLAMMER provides an array of blast radii with a predefined impact area, where 80% or more of the impact area has 90+% suppression. In another embodiment, 90% or more of the impact area has 90+% suppression. In yet another embodiment, 100% of the impact area has 90+% suppression.

In another embodiment, 100% of the impact area has a 90%+lethality due to the number of mortar rounds and overlap of the blast radii within the impact zone, for example.

In some embodiments, a SLAMMER unit loaded with mortars has a weight so that it is movable by one or two people.

DETAILED DESCRIPTION

Figure 1:
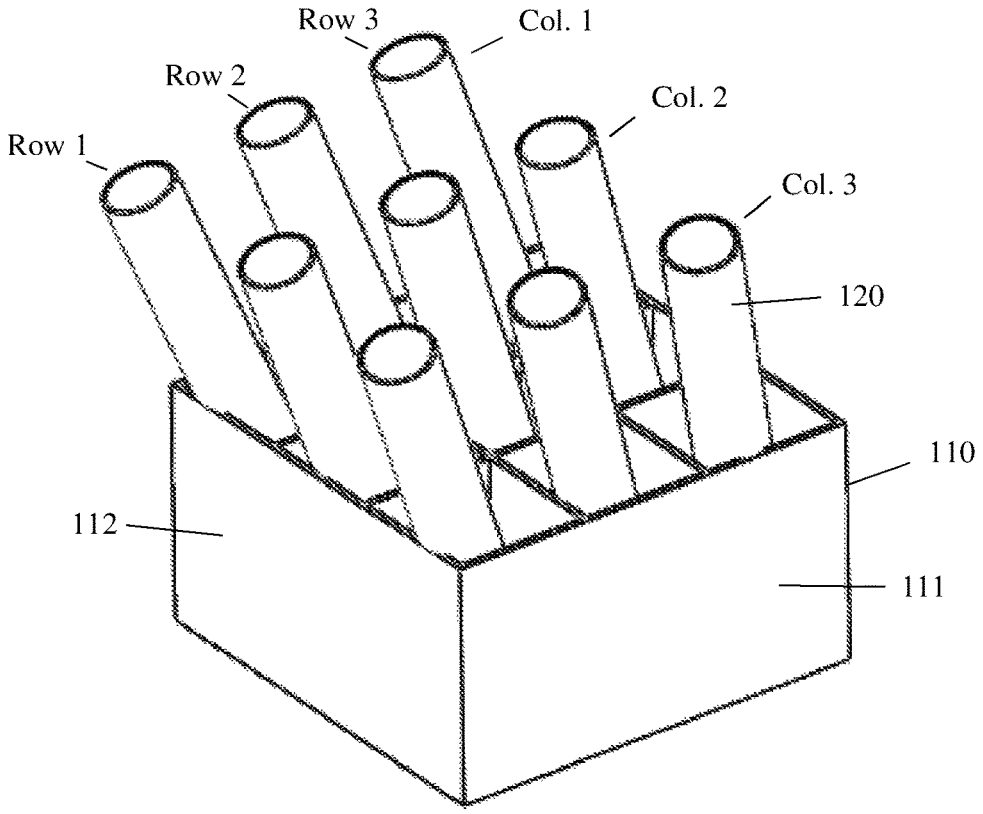
FIG. 1 is a front and side perspective illustration of a multi-barrel mortar launcher, in accordance with an embodiment of the present disclosure.
Figure 2:
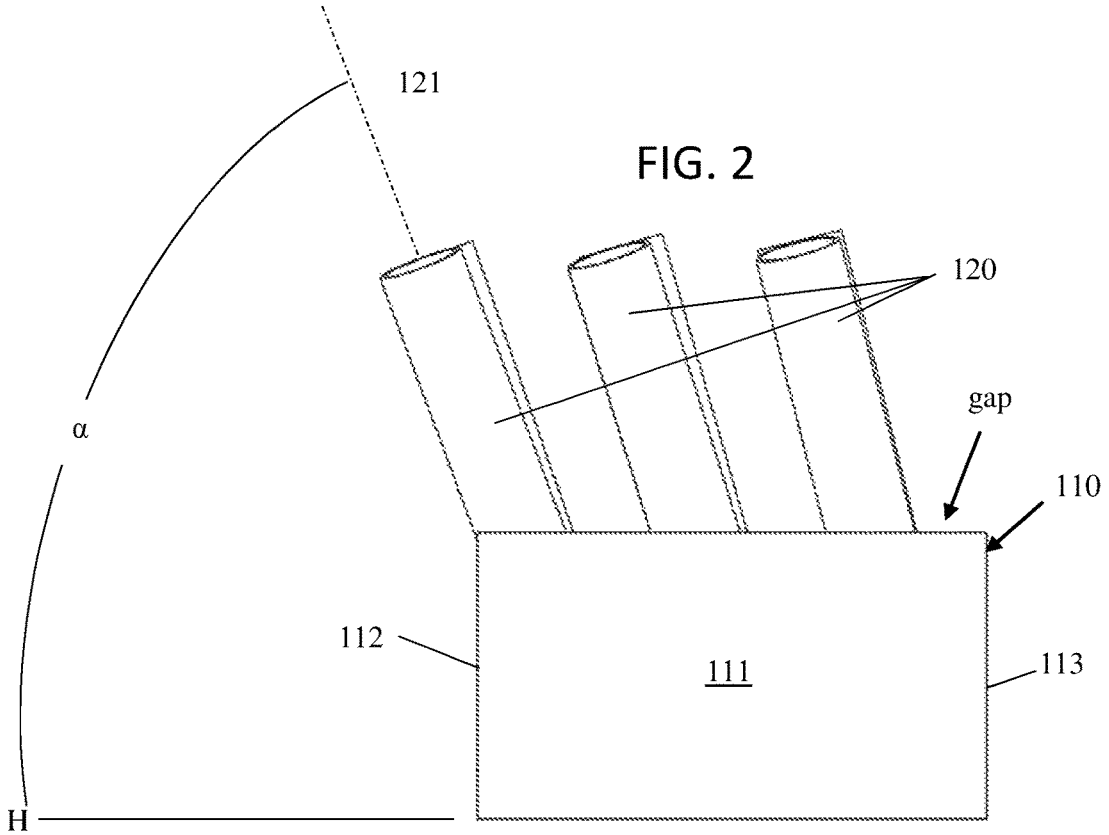
FIG. 2 is a side elevational view of the multi-barrel mortar launcher of FIG. 1, showing the elevation angles of the barrels, in accordance with an embodiment of the present disclosure.
Figure 3:
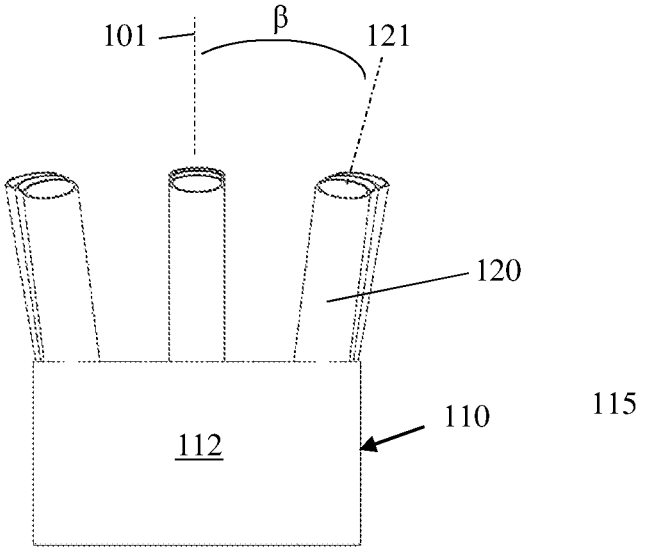
FIG. 3 is a front elevational view of the multi-barrel mortar launcher of FIG. 1 showing the azimuth angle of each of the barrels, in accordance with an embodiment of the present disclosure.

FIGS. 1-3 illustrate views of a multi-barrel mortar launcher 100 in accordance with an embodiment of the present disclosure. FIG. 1 shows a front and side perspective view of the launcher 100; FIG. 2 is a left-side elevational view thereof, and FIG. 3 is a front elevational view thereof. As used herein, embodiments of the launcher 100 may be referred to as SLAMMER, which is an acronym for Short Launch Anti-personnel Multi Mortar Enemy Repeller.

Figure 4:
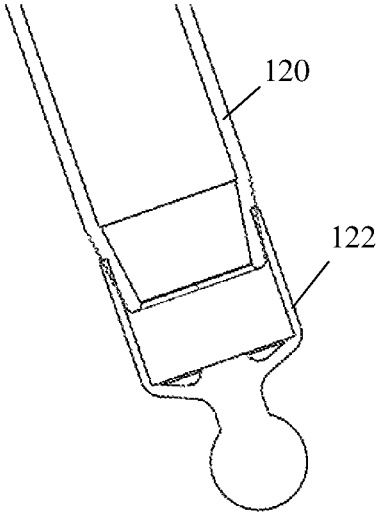
FIG. 4 is a cross-sectional view of a lower end portion of a mortar barrel, in accordance with an embodiment of the present disclosure.

In some embodiments, the launcher 100 may be configured for impact at short range (e.g., 50 m to 150 m), medium range (e.g., 150 m to 250 m), or long range (e.g., 250-350 m). For example, barrels 120 of the launcher 100 have different elevation and/or azimuth angles to launch mortar rounds to an impact area with the blast radii of the mortar rounds distributed throughout the impact area. FIG. 4 illustrates in more detail one embodiment of the mortar launcher. Here, the launcher has a base 110 configured as an open-top enclosure with a box shape. The base 110 optionally features a pop-up front sight, one or more leveling bubble, and a stabilizer. The front sight may be positioned adjacent a top edge of the enclosure. The stabilizer preferably is a flip-down type that is recessed into the enclosure when not in use. Optionally, the stabilizer defines a stake hole for staking the stabilizer to the ground.

The launcher 100 includes a plurality of barrels 120 (e.g., 9 barrels) retained by a base 110 configured as a box-like enclosure. The barrels are disposed within the enclosure and arranged in a barrel array with a front row (Row 1), a middle row (Row 2) and a back row (Row 3). In some embodiments, the launcher 100 optionally includes additional middle rows between the back row and the front row. In some embodiments, the launcher 100 has nine barrels 120 arranged in a rectangular 3×3 or 4×4 barrel array secured to the base 110 configured as an open-top box enclosure. One such embodiment is configured for use with 81 mm mortars. Another such embodiment is configured for use with 60 mm mortars. Barrel arrays with more or fewer barrels 120 and different array configurations are contemplated within the scope of the present invention, such as a polar array.

In one example embodiment of the launcher 100, the base 110 is an open-top enclosure housing barrels 120 in a 3×3 barrel array. Each side face 111 of the launcher 100 measures horizontally from about 12-16 inches in size. The barrels 120 can be configured for 60 mm or 81 mm mortar rounds, or other suitable ammunition. Since the barrels 120 define an elevation angle $\alpha$ to the horizontal H, a gap exists between the back row of barrels and the rear wall 113 of the enclosure. Accordingly, in some embodiments a control module, battery, and/or other supplies can be disposed in an upper, rear portion of the launcher enclosure between the barrels 120 and the inside surface of the base 110 enclosure. The base 110 and enclosure may be made of metals, polymers, or other suitable material. In some embodiments, the base 110 and enclosure are made of a material that is corrosion resistant, since the launcher 100 may be partially embedded into the soil when placed in service.

In another embodiment, the launcher has includes sixteen barrels arranged in a 4×4 barrel array. In some such embodiments, each barrel is configured for 60 mm mortar rounds. For example, the launcher, each side 111 measures about 16 inches from front to back and the front 112 and back 113 measure about 12 inches wide.

In some embodiments, the 60 mm mortar rounds each weigh about 3.75 pounds (i.e., 60 lbs. for 16 mortar rounds), resulting in the launcher in such embodiments having an estimated loaded weight of 90 pounds when loaded with sixteen 60-mm mortars. In another embodiment, the launcher 100 is configured with nine barrels 120 for use with 81 mm mortars. Each 81 mm mortar round weighs about 9.1 pounds, or 82 lbs. for nine mortar rounds, resulting in SLAMMER having an estimated loaded weight of about 110 pounds when loaded with nine 81-mm mortar rounds. In some embodiments, SLAMMER optionally includes a length of control wire or a remote controller. The 60-mm mortar rounds have an estimated muzzle velocity of about 70 m/s and a maximum range of about 370 m when configured with charge zero. The 81 mm mortar rounds have an estimated muzzle velocity of about 70 m/s and a maximum range of 270 m at charge zero.

In some embodiments, each barrel has a barrel axis 121 defining an elevation angle $\alpha$ to the horizontal and an azimuth angle $\beta$ with respect to a central vertical axis 101 extending upward through the center of the launcher 100. When mortars from each barrel 120 are launched at the same time or in rapid succession (e.g., ripple fire), for example, the elevation angle $\alpha$ and azimuth $\beta$ of each barrel 120 are defined so that a mortar round launched from any of the barrels 120 will have substantially the same time-on-target within a target impact zone or "kill zone." In some embodiments, all mortar rounds impact the kill zone within a time span of 5 seconds, including within 3 seconds, within 2 seconds, within 1 second, and within less than one second. Some embodiments of the launcher fire the mortars in a random order, or a predefined but unpredictable sequence that produces chaos in the impact zone.

Referring now to FIG. 4 a cross-sectional views illustrate a lower end portion of a mortar barrel 120 secured to a barrel base 122, in accordance with an embodiment of the present disclosure. In one embodiment, the base 122 of each barrel 120 has a ball shape configured for pivotable movement within a corresponding socket (not shown). For example, the elevation angle α and azimuth β of each barrel 120 can be secured in place before the launcher 100 is ready for use, such as by welding, after initially determining the desired elevation angle α and azimuth β. In other embodiments, the barrel base 122 is determined and fixed during manufacturing.

Figure 5:
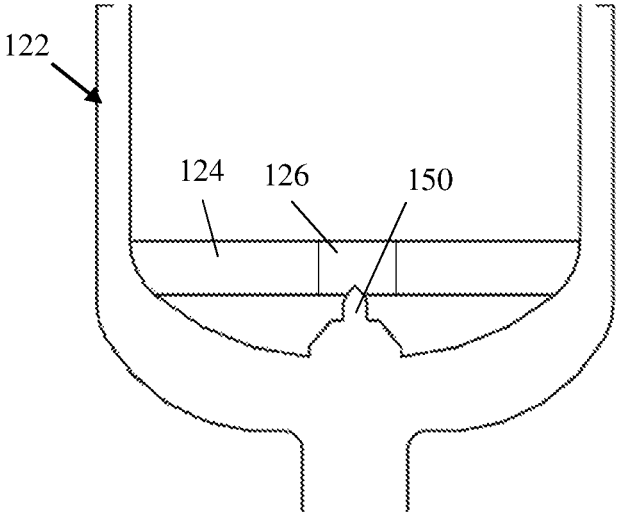
FIG. 5 is a cross-sectional view of a barrel base showing a firing mechanism, in accordance with an embodiment of the present disclosure.

FIG. 5 illustrates a cross-sectional view of a firing mechanism 150 in the base 122 of a barrel 120 in accordance with an embodiment of the present disclosure. The barrel base 122 includes a firing pin 150 that is configured to extend through an opening 126 in the base plate 124 when actuated. In another example, the firing mechanism 150 can include shock tube detonators that eliminate electrical interference. Each barrel 120 can utilize a variety of suitable firing control mechanisms now known or developed in the future, as will be appreciated.

In some embodiments, each barrel 120 has a barrel length from 15 to 24 inches, including 16, 16.5, 17 18, 20, and 22, inches, for example. In one embodiment, each barrel 120 has a barrel length of 16 or 16.5 inches. Such a barrel size provides a compact size of the launcher 100 while also being sufficient to deliver a mortar to a kill zone a desired distance away from the launcher 100 (e.g., 70 to 270 meters). Barrels 120 may be made of metals, such as steel, aluminum, or one of the nickel-chromium-based superalloys known as Inconel. In other embodiments, the barrels 120 are made of a reinforced polymer or other material suitable to withstand the pressure generated when a charge zero mortar is launched, which is generally below 2000 psi in some cases.

Some embodiments of the launcher are configured for a single use, therefore reducing the need for durable and heat resistant materials. For example, each barrel 120 is configured to sustain a single launch and the launcher 100 as a whole is constructed to withstand all barrels launching substantially at one time or in rapid succession. In other embodiments, the launcher is configured for repeated use, which may necessitate each barrel being made of a material with structural properties suited for launching many mortars from each barrel, as will be appreciated.

Figure 6:
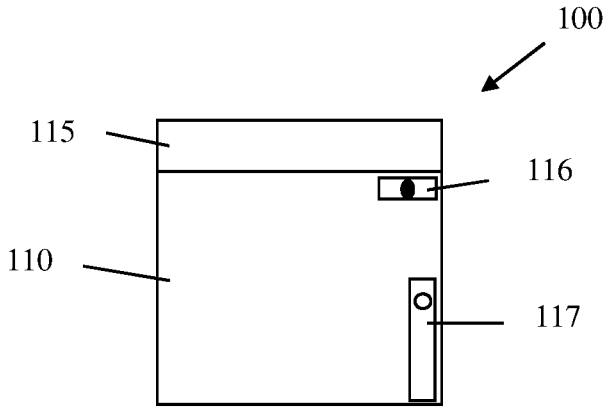
FIG. 6 is an elevational view of an enclosure containing a multi-barrel mortar launcher and including a fold-down stake and a bubble level, in accordance with an embodiment of the present disclosure.

Referring now to FIG. 6, a front elevational view shows launcher 100 in accordance with another embodiment of the present disclosure. The launcher 100 includes a cover 115 that can be secured to the base 110, such as to close the box-shaped enclosure. For example, the cover optionally includes handles that fold out from opposite sides of the cover 115 and are useful for carrying the mortar launcher 100. One or more fold-down stakes 117 can be used to stabilize the launcher 100 on the ground. Optionally, the launcher includes one or more bubble level 116 secured to the base 110, which can be used to level the launcher 100 when situated on the ground, embedded in soil, on a vehicle, on a building, or in some other location, for example. The inside of the cover may be used to store supplies, such as securing stakes, batteries, endcaps, shock tube detonators, and a coil of wire. In one embodiment, for example, the wire has a length from 100 to 1000 meters to extend from "box to box" when a plurality of mortar launchers are used together. In one embodiment, the launcher 100 includes a fire control unit with wired or wireless activation, a mortar box control unit 1, wire for wired control or an antenna to receive wireless control signals, a base 110 configured as a mortar box control unit, an ignition charge or firing pin 150 for each barrel 120. In one embodiment, mortars are fired by a solenoid actuator in each barrel. In other embodiments, a hammer, firing pin, or striker is mechanically activated to cause each mortar to fire. In another embodiment, each barrel 120 includes a nonel shock tube detonator, similar to detonators used on claymore mines.

In some embodiments, the fire control unit has an embedded circuit board controller designed and constructed to be waterproof, shockproof, and EMP—(electromagnetic pulse) proof. For example, the fire control unit has an electrical control connection, which may be an embedded wire connection or an antenna for receiving a wireless signal. In one embodiment, the fire control unit has clear plastic covers that protect the on/off button or power switch, and the fire button. In one embodiment, the power switch displays "ON" in tritium green and the fire button displays "FIRE" in tritium green. The fire control unit optionally includes a system test, a timer, and a battery module. Firing options include operator direct fired, remote fired, timer fired, and direct fire option. The firing mode may be configured for forest, urban, and jungle environments. Firing platforms include the ground, wheeled vehicles, tanks, armored fighting vehicles, ATVs, trailers (hand trailers and vehicle-pulled trailers), and sea craft.

Figure 7:
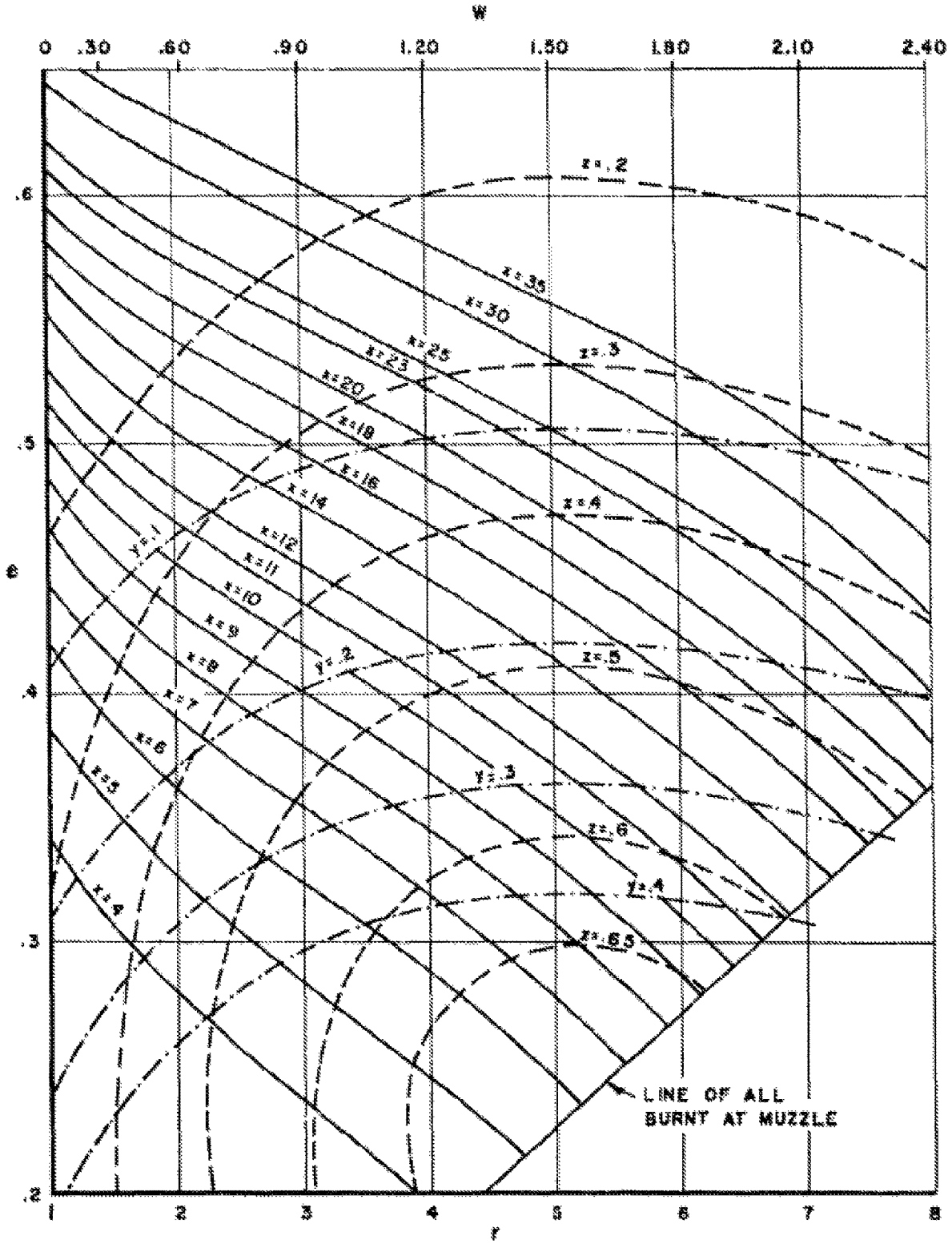
FIG. 7 is a compiled ballistics table form of Mayer-Hart assumptions.

FIG. 7 shows a ballistics chart compiled form Mayer-Hart assumptions from the Journal of the Franklin Institute, volume 240 from November 1945. Variables shown on the chart are as follows:

e: ballistic efficiency
z: piezometric efficiency
x: free volume expansion ratio
r: ballistic parameter Ballistic energy e, piezometric efficiency z, and the ballistic parameter r are all used to calculate the muzzle velocity $V_0$ based on the amount of propellant used to launch the mortar. The free volume expansion ratio x and the ballistic parameter r, ballistic efficiency, e, and the chamber pressure $P_{max}$ are calculated based on equations (1), (2), (3), and (4) below (or equivalents):

$$\text{Free volume expansion ratio, } x=(U-C/(\rho+AL))/(U-C/\varphi \quad (1)$$

$$\text{Ballistic parameter, } a=(FC/U_0P_{max})=FC/(P\max(U-C/\varphi) \quad (2)$$

$$\text{Ballistic efficiency, } e=((\gamma-1)/2)(M+C/3)V^2/(386FC) \quad (3)$$

$$\text{Pressure, } P\max=(1+C/3M)/(1+C/2M) \quad (4)$$

After calculating values for the free volume expansion ratio x and the ballistic parameter r, the ballistic efficiency e can be determined using a ballistics chart, such as shown in FIG. 9. From these values, the muzzle velocity $V_0$ can be calculated.

Table 1 below illustrates calculated values for muzzle velocity $V_0$ (ft./sec.) for mortars fired from barrels 120 of various barrel lengths (16", 18", 24", and 32") for 50 grain black powder mortar ignition cartridges, which are referred to as "charge zero." The numbered value from 1-4 in the charge column indicates the number of propellant charges, which are generally used in full size mortars as traditionally fired from a single tube. A value of "0" indicates that only an ignition charge is present. Values for charge of 1, 2, 3, and 4 indicate the number of propellant charges added to the basic ignition charge. The right side of each chart shows values for $V_0$ as calculated compared to published values of $V_0$ for purposes of validating the calculation methodology.

With a muzzle velocity of about 195 ft./s, a 60-mm mortar round (charge 0) has a maximum range of about 370 m.

TABLE 1

50 grain mortar ignition cartridge, pressure P = 1700 psi

| Charge | $V_0$, 16" barrel | $V_0$, 18" barrel | $V_0$, 24" barrel | $V_0$, 32" barrel | $V_0$, pub. | $V_0$, calc. |
|---|---|---|---|---|---|---|
| 0 | 200.3 | 210.5 | 208.1 | 192.4 | 210 | 192.4 |
| 1 | 371.7 | 407.6 | 422.7 | 429.8 | 415 | 429.8 |
| 2 | 492.6 | 537.7 | 561.7 | 576.9 | 560 | 576.9 |
| 3 | 595.7 | 645.7 | 674.6 | 695.9 | 680 | 695.9 |
| 4 | 690.1 | 740.4 | 773 | 801.8 | 810 | 801.8 |

Figure 8:
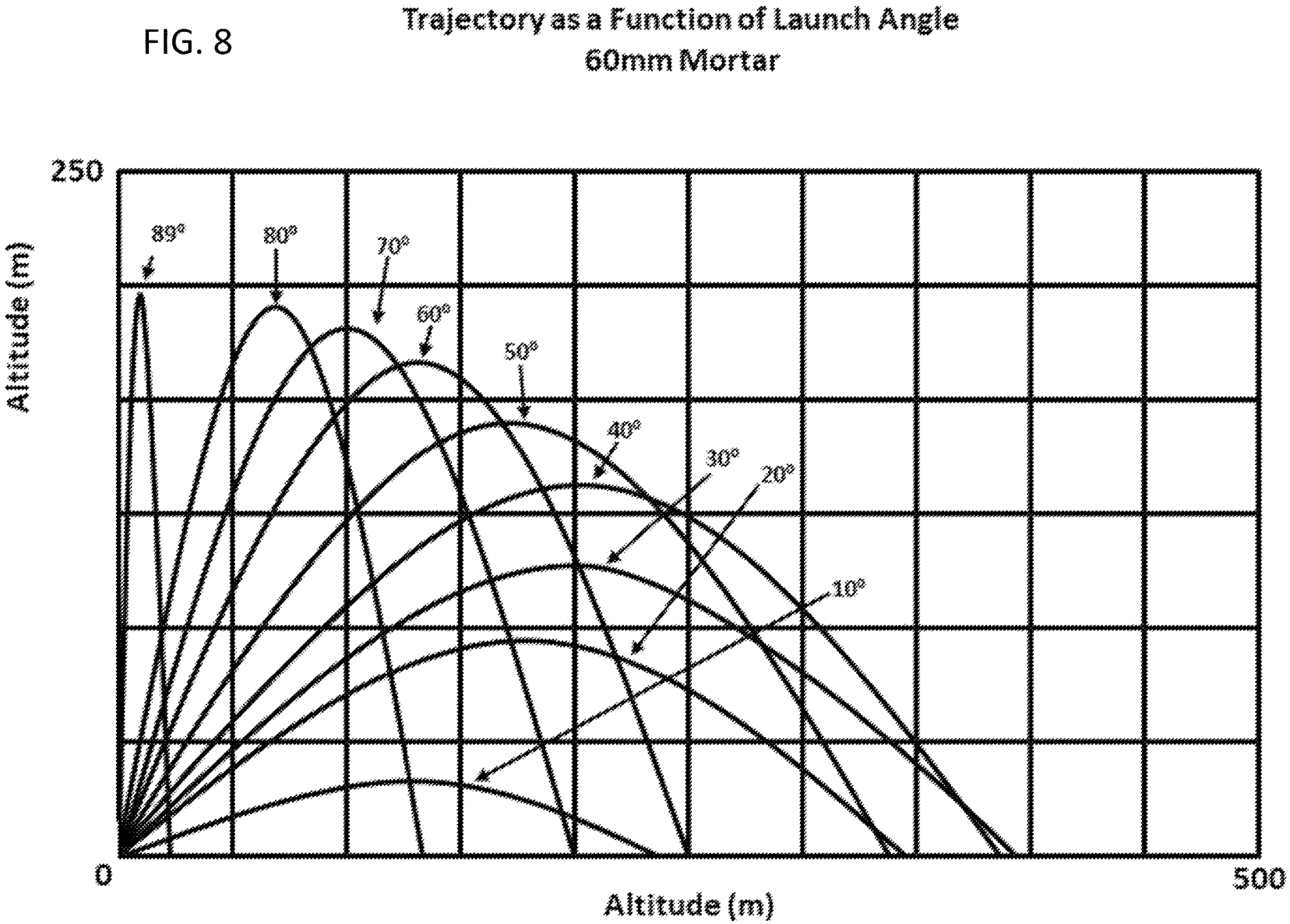
FIG. 8 is a plot of trajectories for a 60 mm mortar at launch angles from 10 degrees to 89 degrees from an 18" barrel, in accordance with an embodiment of the present disclosure.

FIG. 8 is a plot showing trajectory as a function of elevation angle for a 60 mm mortar and a barrel length of 18 inches, where altitude is plotted against range for elevation angles from 10° to 89°. According to the trajectory plot, an elevation angle of 75° provides a range of about 200 meters for a 60-mm mortar configured for charge zero. Time of flight can be calculated using kinematic equations based on muzzle velocity $V_0$, mass of the mortar (e.g., 3.75 kg), and other physical parameters, as will be appreciated. Accordingly, the elevation angle $\alpha$ and azimuth angle $\beta$ for each barrel can be determined for a given barrel length and desired range. In one example for a 60 mm mortar, an elevation angle $\alpha$ of 81° provides the desired range of about 200 meters.

Calculations discussed above may be used to configure SLAMMER with the desired lethality, range, and distribution of blast radii within a defined impact area based on the particular mortar shell used (60 mm, 81 mm, etc.), barrel length, and number n of propellant charges, in accordance with some embodiments of the present disclosure. Using such calculations, the launcher 100 can be configured to fire mortars from each barrel and impact within a specified kill zone, as will be appreciated.

In one example embodiment, the launcher 100 has nine barrels 120 arranged in a 3×3 array with Row 1 being the front row of barrels 120. In this example, the barrel length is eighteen inches. The middle of the kill zone is 220 meters from the launcher 100. In other words, the kill zone is about 100 m wide and 100 m long, spanning a range from 170 to 270 meters. The barrels have the following values for azimuth angles $\beta$ and elevation angles $\alpha$ ($\beta$, $\alpha$). The group of burst radii are distributed across the impact area or kill zone covering 10,000 square meters (100 m×100 m).

| | Col. 3 | Col. 2 | Col. 1 |
|---|---|---|---|
| Row 1 (front) | −7.3°, 70° | 0°, 71° | 7.3°, 70° |
| Row 2 | −8.4°, 73° | 0°, 74° | 8.4°, 73° |
| Row 3 | −9.8°, 76° | 0°, 76° | 9.8°, 76° |

In another example embodiment, the launcher 100 has nine barrels 120 arranged in a 3×3 array with Row 1 being the front row of barrels 120. In this example, the barrel length is also eighteen inches. The middle of the kill zone is 120 meters from the launcher 100. In other words, the kill zone is 100 m wide and has a range from 70 m to 170 m The barrels have the following values for azimuth angles $\beta$ and elevation angles $\alpha$ ($\beta$, $\alpha$). As with the example above, the group of burst radii are distributed across the impact area or kill zone covering 10,000 square meters (100 m×100 m).

| | Col. 3 | Col. 2 | Col. 1 |
|---|---|---|---|
| Row 1 (front) | −12°, 79° | 0°, 79° | 12°, 79° |
| Row 2 | −15.1°, 81° | 0°, 82° | 15.1°, 81° |
| Row 3 | −20.3°, 84° | 0°, 84° | 20.3°, 84° |

In one embodiment, the launcher 100 has sixteen barrels each configured for 60 mm mortars. In another embodiment, the launcher 100 has nine barrels configured for 81 mm mortars. In each embodiment, the elevation angle $\alpha$ and azimuth angle $\beta$ of each barrel 120 can be configured to deliver mortars launched from all of the barrels (16 or 9, respectively) with time on target impact in the 100 m×100 m kill zone defined by an array of burst radii corresponding to the barrels. Kill zones of other dimensions and ranges are acceptable.

The kill zone or impact area is defined by an array of burst radii, where each burst radius corresponds to a mortar round launched from one of the barrels 120 in the array of barrels. For example, a nine-barrel array launches nine mortar rounds that result in nine burst radii distributed in a burst array across the kill zone or impact area. In one embodiment, the impact area measures 100 m×100 m and extends across a range of 70-170 meters (e.g., a short range embodiment), 170-270 meters (e.g., a medium range embodiment), or 270-370 meters (e.g., a long range embodiment) from the launcher 100. In other embodiments, the barrel array, and therefore the array of burst radii or kill zone, can be tailored for specific shapes. For example, the launcher 100 can have a 2×8 array of barrels, 3×2 array of barrels, a 4×4 array of barrels, a 2×2 array of barrels, a 3×1 array of barrels, a 4×8 array of barrels, or other barrel array that provides the desired size and shape of kill zone and/or targeted kill zone lethality, as will be appreciated. Additionally, for each array of barrels 120, the elevation angle $\alpha$ and azimuth $\beta$ of each barrel 120 in the array can be set to provide the desired range, kill zone dimensions, and kill zone shape, burst radius overlap, and other performance features, as will be appreciated.

Figure 9A:
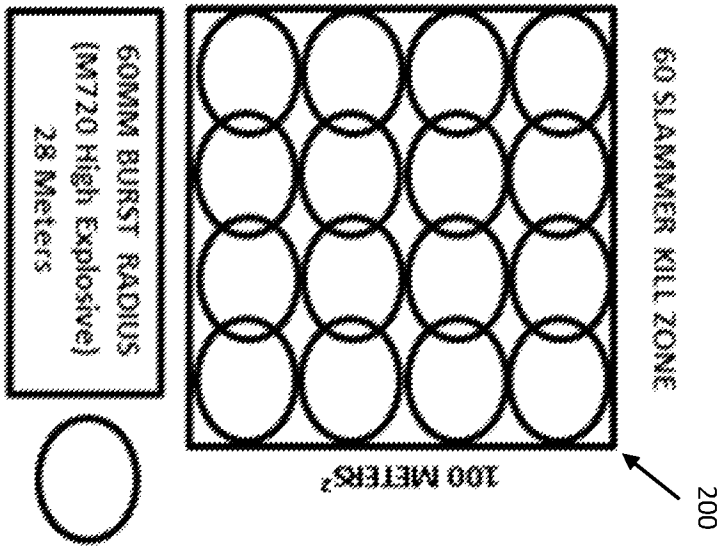
FIG. 9A illustrates a top plan view of an impact zone measuring 100 m×100 m and comprising sixteen blast radii from sixteen 60 mm mortars each having a blast radius of 28 meters, in accordance with an embodiment of the present disclosure.
Figure 9B:
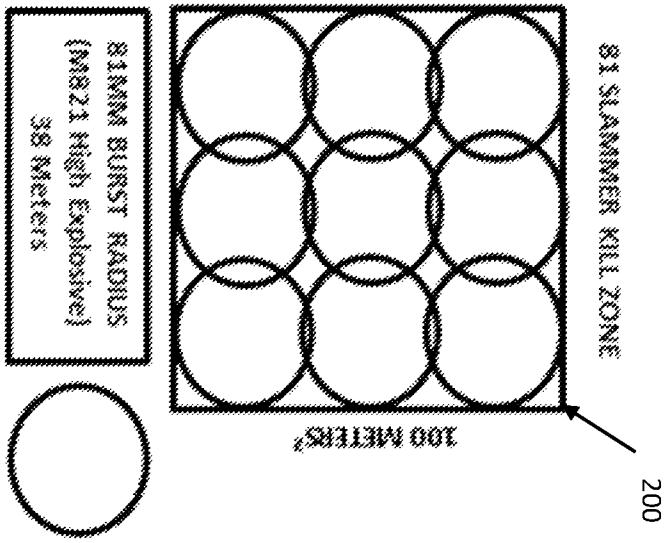
FIG. 9B illustrates a top plan view of an impact zone measuring 100 m×100 m and comprising nine blast radii from nine 81 mm mortars each having a blast radius of 38 meters, in accordance with an embodiment of the present disclosure.

FIGS. 9A and 9B illustrate an example of the burst radii in the impact zones or kill zones 200 for the launcher 100 configured with sixteen 60 mm mortars and nine 81 mm mortars, respectively. A 60 mm mortar (e.g., configured with M720 High explosive), has a burst radius of 28 meters; an 81 mm mortar has a burst radius of 38 meters. In the embodiment of FIG. 9A, the launcher 100 has sixteen rounds of 60 mm HE mortars that land inside a 100 m×100 m impact area. Approximately 80% of that area (8000 $m^2$) has a suppression probability of 90+% and 20% area (200 $m^2$) with a 50+% probability of suppression based on flat ground and stipulated casualty probabilities for mortars.

In the embodiment of FIG. 9B, an array of 38 m burst radii corresponds to the nine 81 mm mortars. The burst radii combine to provide a rectangular impact area or kill zone of 10,000 $m^2$ (100 m×100 m). As discussed here, "burst radius" refers to the radius within which the blast has a 90% or greater probability of suppression. In the embodiment of 9B, the launcher 100 has nine rounds of 81 mm HE inside a 100×100 M impact area, where approximately 90% of the impact area (9000 $m^2$) has a suppression probability of 90+% and 10% of the impact area (100 $m^2$) has a 50+% probability of suppression based on flat ground and stipulated casualty probabilities for mortars. In other embodiments, the launcher 100 may be configured to deliver overlapping blast radii in the impact zone, where the impact zone has 100% (or other value as desired) coverage of 90+% suppression or even greater lethality within the impact zone.

Figure 10A:
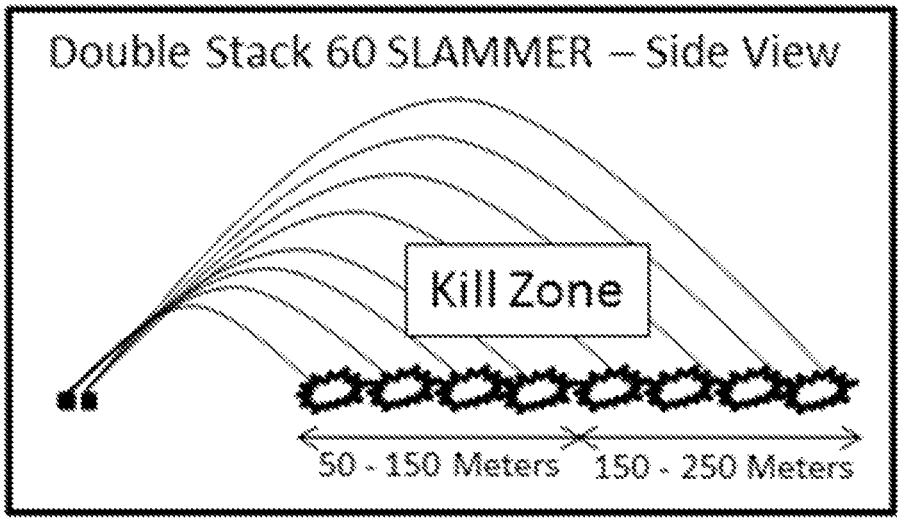
FIGS. 10A-10B each illustrate a side view of two SLAMMER launchers arranged in a double stack and launched together to produce a kill zone in a range from 50 to 250 meters from the point of fire, where one of the SLAMMER units is configured for shorter range of 50-150 meters and another unit is configured for 150-250 meters, in accordance with an embodiment of the present disclosure.
Figure 10B:
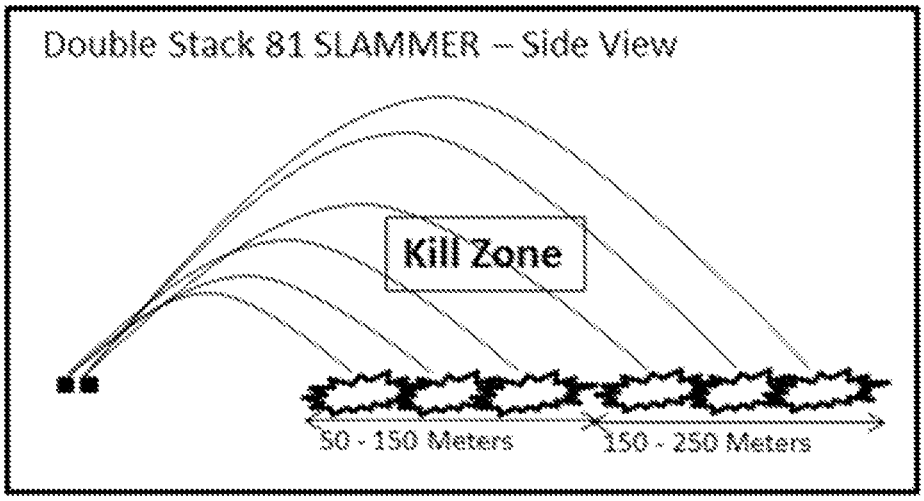

FIG. 10A illustrates the kill zones or impact areas for two SLAMMERS used together in a triple stack, where each SLAMMER is configured for 60 mm mortars. The kill zone of the first SLAMMER extends from 50 to 150 meters and the kill zone of the second SLAMMER extends from 150 to 250 meters. In another embodiment a third SLAMMER completes a "triple stack" with the kill zone of the third SLAMMER extending from 250 to 350 meters. Thus, the impact area or kill zone of the double stack is 100 m×200 m and the kill zone of the triple stack is 100 m×300 m. Similarly, FIG. 10B illustrates the kill zones or impact areas for a double stack of SLAMMERS used together, where each SLAMMER is configured for 81 mm mortars. The kill zone of the first SLAMMER extends from 50 to 150 meters and the kill zone of the second SLAMMER extends from 150 to 250 meters. Thus, the impact area or kill zone of the triple stack is 100 m×200 m.

Figure 11A:
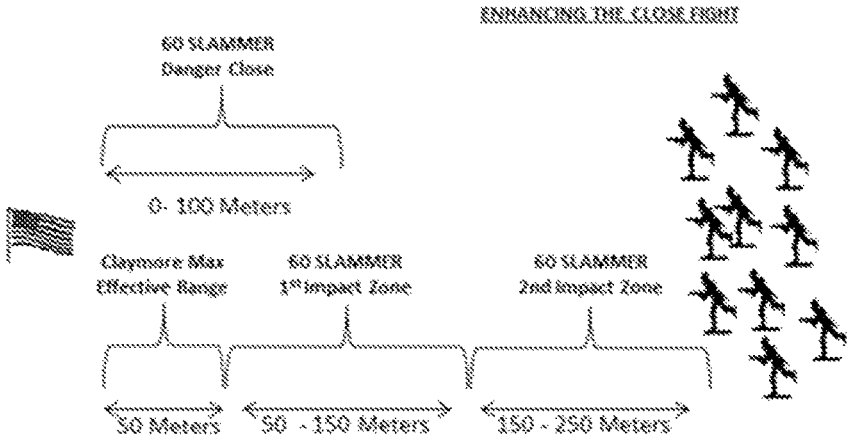
FIG. 11A is a diagram showing the useful range of a SLAMMER launcher configured for 60-mm mortars, in accordance with an embodiment of the present disclosure.
Figure 11B:
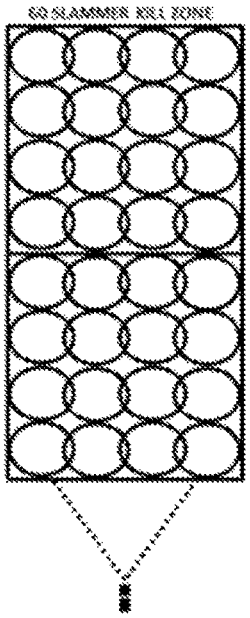
FIG. 11B illustrates a top plan view of the kill zone and blast radii from a double stack of SLAMMERs, in accordance with an embodiment of the present disclosure.

FIGS. 11A-11B show an example of two SLAMMERs 100 (i.e., a "double stack") used together to provide an impact area 200 with a range of 50-250 meters from the launch site using 60 mm mortars. The first launcher 100 has a range of 50-150 meters and the second launcher 100 has a range of 150-250 meters. A third SLAMMER can be added to create a triple stack, where the third launcher 100 has a range of 250-350 meters from the defensive perimeter edge. Similarly, three 81 mm mortars units may be used (nine tubes in each unit) for a kill zone of 100 m wide×300 m deep (50-350 m). As shown in FIG. 11A, for example, the first impact area begins about where the effective range ends for claymore mines (about 50 m). As shown in FIG. 11B, the burst radii of adjacent mortars overlap to some extent to minimize non-lethal areas within the kill zone.

Figure 12A:
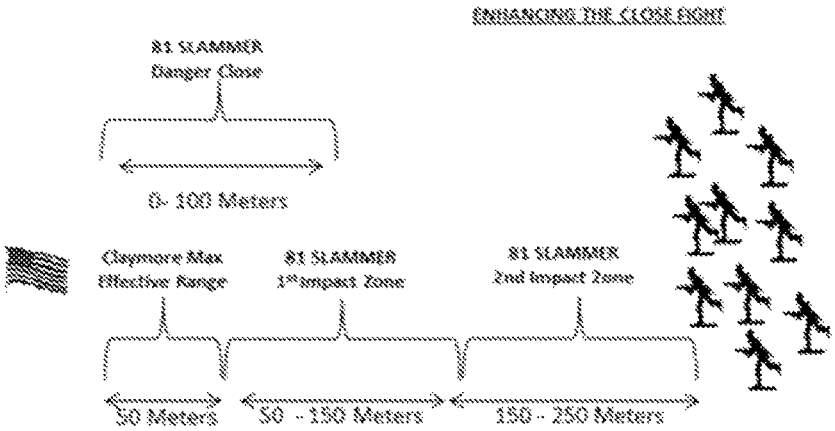
FIG. 12A is a diagram showing the useful range of a SLAMMER launcher configured for 81-mm mortars, in accordance with an embodiment of the present disclosure.
Figure 12B:
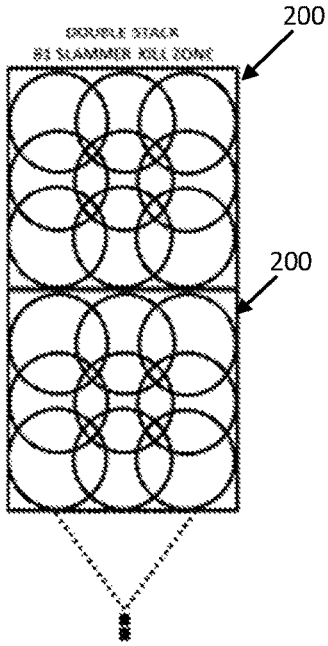
FIG. 12B illustrates a top plan view of the kill zone and blast radii from a double-stack of SLAMMERs, in accordance with an embodiment of the present disclosure.

FIGS. 12A and 12B show another example of two SLAMMERs 100 (i.e., a "double stack") used together to provide an impact area 200 with a range of 50-250 meters from the launch site using 81 mm mortars. The first impact zone 200 is 50-150 meters and the second impact zone is 150-250 meters. A third SLAMMER can be added to create a triple stack, where the third launcher 100 has a range of 250-350 meters from the defensive perimeter edge. In comparison, the maximum effective range of claymore mines is 50 meters. Thus, embodiments of SLAMMER 100 are useful to enhance the lethal firepower of other weapons in a close fight.

Figure 13A:
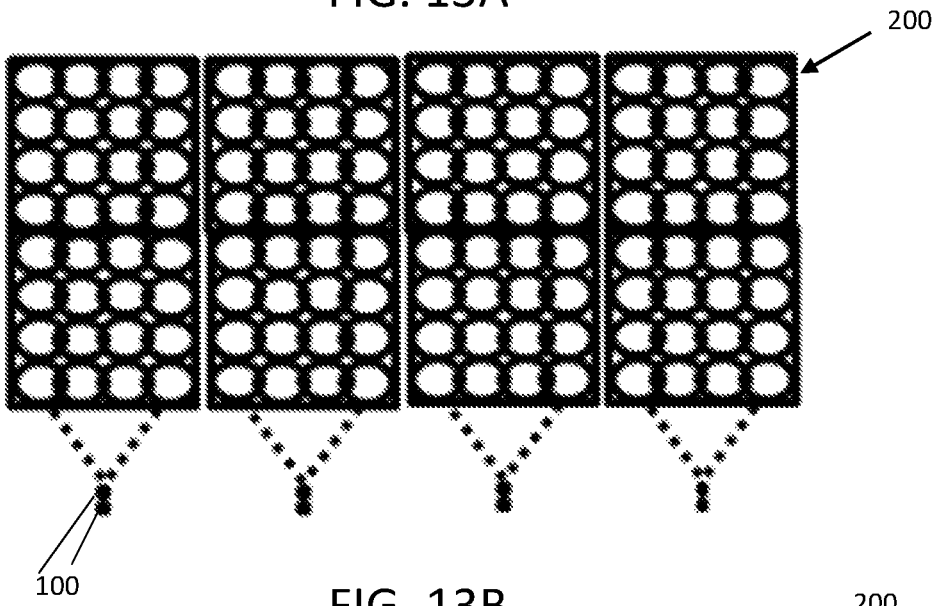
FIG. 13A illustrates a top plan view of nine impact areas with blast radii of eight 60 mm SLAMMER units used en masse and configured as four double-stacks to provide a kill zone 400 m wide by 200 meters long, in accordance with an embodiment of the present disclosure.
Figure 13B:
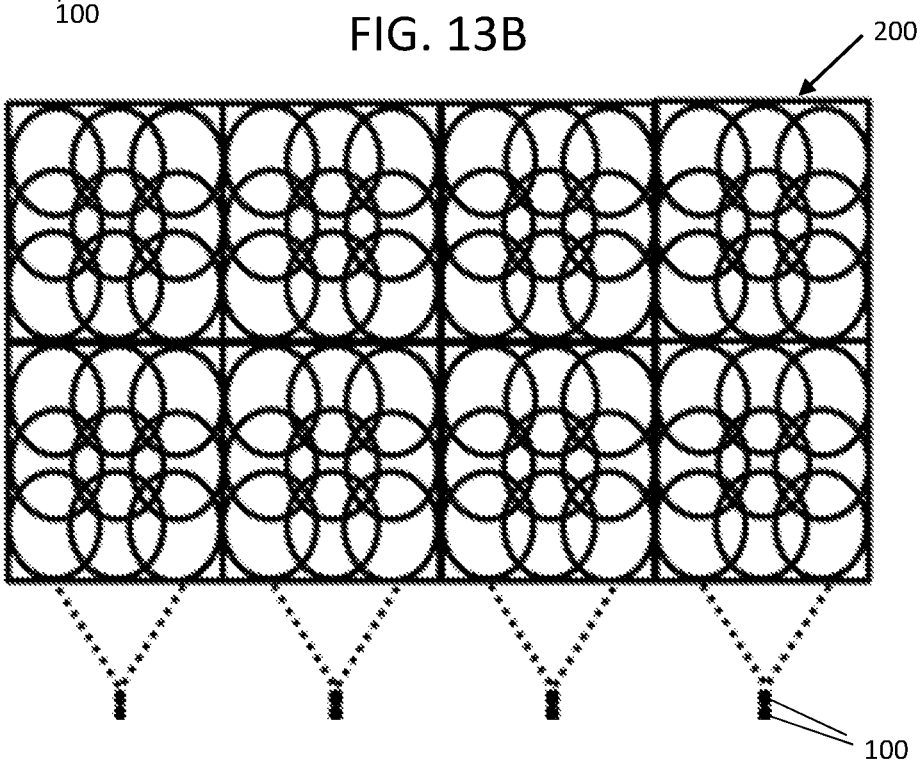
FIG. 13B illustrates a top plan view of eight impact areas with blast radii of eight 81 mm SLAMMER units used en masse and configured as four double-stacks to provide a kill zone 400 m wide by 200 meters long, in accordance with an embodiment of the present disclosure.

FIGS. 13A and 13B show an example of a plurality of multi-barrel mortar launchers 100 used en masse with 60 mm and 81 mm mortars, respectively. Here, eight kill zones 200 correspond to eight SLAMMERS arranged in four double stacks. In FIG. 13A, the kill zone of each SLAMMER 100 has an array of sixteen overlapping blast radii of 60 mm mortars. In FIG. 13B, the kill zone of each SLAMMER 100 has an array of nine overlapping blast radii of 81 mm mortars. For each of the four SLAMMER double stacks, the first impact zone is 50-150 meters and the second impact zone is 150-250 meters, for example.

In one example, SLAMMER can be used for direct fire operation in a jungle or forest as well as the optional direct fire MOUT (Military Operations in Urban Terrain). For example, two SLAMMER units can be pointed in a direct fire mode in a jungle to allow use of mortars at ranges under 100 meters when traditional deployment is not effective due to the extensive vegetative jungle canopy. For example, two SLAMMER units pointed in a direct fire mode in urban warfare can allow building faces to be engaged when traditional deployment will not be effective. SLAMMER in direct fire can be used individually, in pairs, or in clusters. In direct fire, SLAMMER can be used defensively or offensively. Clusters enable sustained defensive operations where battlefield conditions justify this type of direct fire at a short range.

Figure 14:
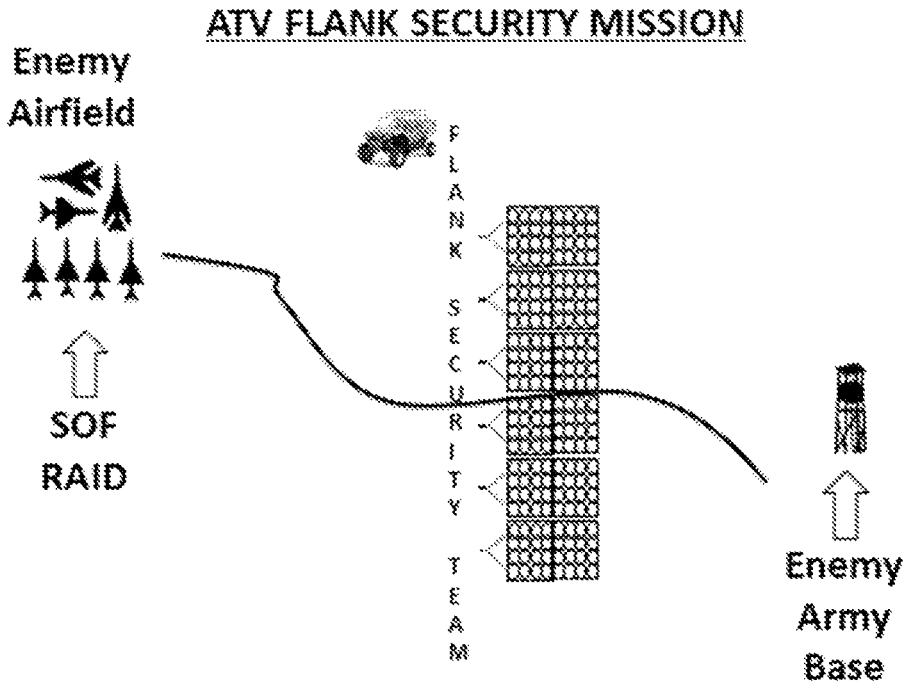
FIG. 14 illustrates an example of using six double stacks of SLAMMERS for flank security in a raid on an enemy airfield, in accordance with an embodiment of the present disclosure.

FIG. 14 illustrates an example of SLAMMERs used by Special Operations force raid on an enemy airfield, where a two-person flank security team uses a trailer and ATV and trailer to deploy twelve SLAMMERS and establish a flank security killbox between the enemy airfield and the enemy army base barracks. This strategy increases the response time of enemy forces from the army base to enable improved success during the assaulting force raid.

Figure 15:
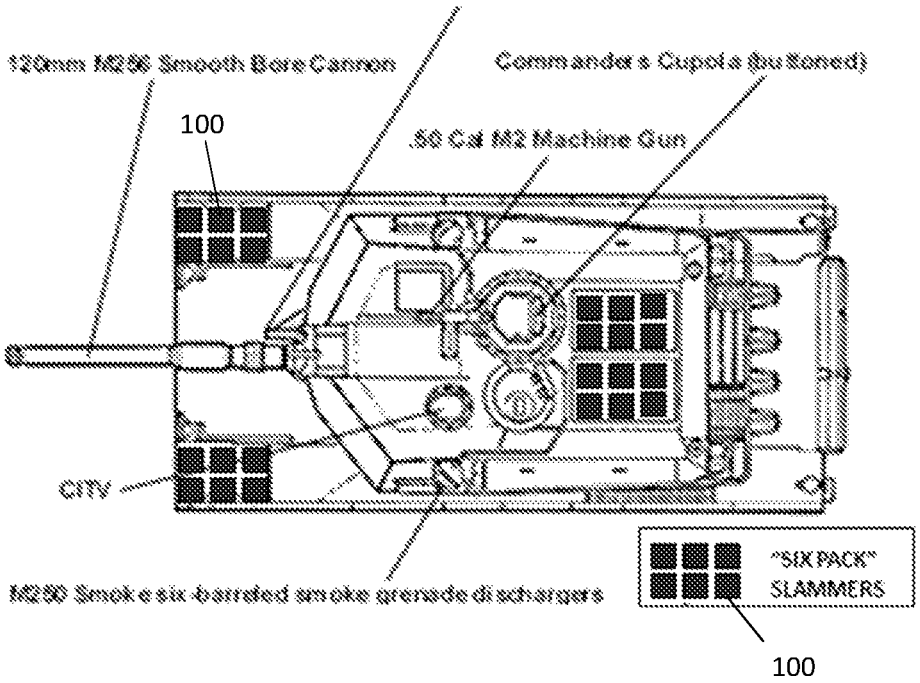
FIG. 15 illustrates a top plan view of an example of an M1 tank equipped with two six packs of SLAMMERS on both the front bumpers and the turret bustle, in accordance with an embodiment of the present disclosure.

FIG. 15 illustrates a plan view of an M1 battle tank configured with a plurality of SLAMMERs 100 in six-packs on the right front fender, the left front fender and on the turret bustle.

Figure 16:
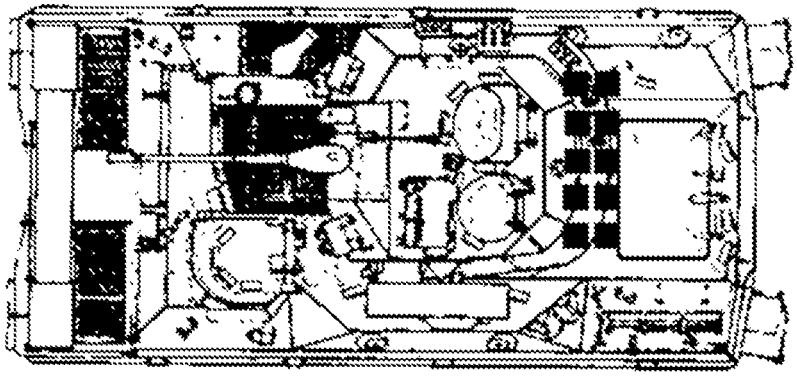
FIG. 16 illustrates a top plan view of an example of a M2 Bradley tank equipped with five double stack SLAMMERs at the rear of the turret bustle, in accordance with an embodiment of the present disclosure.

FIG. 16 illustrates a plan view of an M2 Bradley fighting vehicle with a plurality of SLAMMERs 100 on the vehicle arranged in five groups of two SLAMMERs on the turret bustle.

Figure 17:
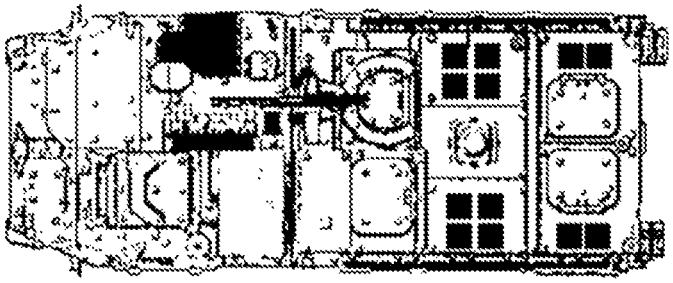
FIG. 17 illustrates an example of a Stryker fighting vehicle equipped with two groups of two and four SLAMMER units, in accordance with an embodiment of the present disclosure.

FIG. 17 illustrates a plan view of a Stryker fighting vehicle with groups of SLAMMERs 100 mounted to the vehicle in groups of two and four units.

Embodiments of SLAMMER provide unprecedented lethality for use quickly and easily in a close battle. SLAMMER can be configured to be a single-use weapon or have a durable design for repeated firing. Some embodiments of SLAMMER augment existing warfare by being simple and by using commercial-off-the-shelf mortar rounds (e.g., 60 mm and 81 mm mortars) and equipment (e.g., firing mechanisms). Due to its simplicity, SLAMMER is rugged, reliable, fully meets Mil. Std. specifications. SLAMMER is highly lethal to the enemy while being safe to operate, versatile, modular, and self-contained.

FURTHER EXAMPLE EMBODIMENTS

Example 1 is a multi-barrel mortar launcher comprising: a base; a plurality of mortar barrels secured to the base and arranged in a barrel array, each of the plurality of mortar barrels having a closed proximal end adjacent the base and an open distal end directed upward from the base, wherein each of the plurality of barrels has a distinct combination of an elevation angle and an azimuth angle with respect to other ones of the plurality of mortar barrels; and a firing control mechanism operatively connected to the proximal end of each of the plurality of mortar barrels and configured to cause a mortar to launch from each of the plurality of mortar barrels. For example, the base can be configured as a plate, a tray, a frame, a box, or other structure. The base can be configured to enable a variety of methods of stabilizing the launcher. For example, the base is embedded into the ground or stabilized with sandbags when positioned on top of a hard surface.

Example 2 includes the subject matter of Example 1, wherein the firing control mechanism causes firing from each of the plurality of barrels at substantially the same time.

Example 3 includes the subject matter of Examples 1 or 2, wherein mortars launched from the plurality of barrels have a time-on-target impact within a window of time less than five seconds.

Example 4 includes the subject matter of Example 3, wherein the window of time is less than three seconds.

Example 5 includes the subject matter of Example 3, wherein the window of time is less than two seconds.

Example 6 includes the subject matter of Example 3, wherein the window of time is less than one second.

Example 7 includes the subject matter of any of Examples 1-6, wherein each of the plurality of barrels has an elevation angle from 45° to 85° with respect to the horizontal, and wherein each of the plurality of barrels has an azimuth angle from 5° to 24° with respect to a central vertical axis.

Example 8 includes the subject matter of Example 7, wherein the elevation angle is from 45° to 72° with respect to the horizontal, and azimuth angle from 5° to 15°.

Example 9 includes the subject matter of Example 7, wherein the elevation angle is from 70° to 85° with respect to the horizontal, and azimuth angle from 10° to 20°

Example 10 includes the subject matter of any of Examples 7-9, wherein the elevation angle and the azimuth angle of each of the plurality of mortar barrels defines a mortar impact area at least 20 meters wide and at least 20 meters long. For example, the impact area can have a rectangular shape, an L shape, an H shape, a circular shape, or other shape suited to the terrain.

Example 11 includes the subject matter of Example 10, wherein mortars fired from each of the plurality of mortar barrels defines an array of mortar blast radii having an impact area of about 100 meters wide×100 meters long.

Example 12 includes the subject matter of any of Examples 1-11, wherein the impact area of mortars fired from each of the plurality of mortar barrels is between 50 meters and 370 meters from the multi-barrel mortar launcher.

Example 13 includes the subject matter of any of Examples 1-12, wherein each of the plurality of mortar barrels is configured for 60-mm mortars, 81-mm mortars, 82-mm mortars, 107-mm mortars, 120-mm mortars, or other calibers.

Example 14 includes the subject matter of any of the foregoing examples, wherein mortars launched from each of the plurality of barrels have substantially the same time-on-target.

Example 15 includes the subject matter of any of Examples 1-14, wherein the barrel array is selected from one of a 3×3 array, a 4×4 array, a 3×5 array, a 3×4 array, a 2×3 array, a 2×4 array, a 4×6 array, an 8×4 array, a 3×1 array, a 2×5 array, or other array combinations.

Example 16 includes the subject matter of any of Examples 1-15, wherein the base is configured as an open-top box.

Example 17 includes the subject matter of any of Examples 1-16, wherein the firing control mechanism is configured to fire all of the plurality of mortar barrels due to a single fire actuation by a user.

Example 18 includes the subject matter of any of Examples 1-17, wherein the firing control mechanism comprises a nonel detonator.

Example 19 is a method of mortar defense comprising: providing a multi-barrel mortar launcher; loading one mortar into each of the plurality of mortar barrels; causing the mortar to launch from each barrel of the multi-barrel mortar, thereby causing an array of blast radii defining a kill zone corresponding to the barrel array and having substantially the same time-on-target.

Example 20 includes the subject matter of Example 19, wherein the multi-barrel mortar launcher is defined by any of the Examples 1-18.

Example 21 includes the subject matter of any of Examples 19 or 20 and further comprises recessing the multi-barrel mortar launcher in the ground.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A multi-barrel mortar launcher comprising:

a base configured as a box with an open top;

a plurality of mortar barrels secured in the box and arranged in a barrel array, each of the plurality of mortar barrels having a closed proximal end in the box and an open distal end directed upward from the open top of the box, wherein each of the plurality of barrels has a distinct combination of an elevation angle and an azimuth angle with respect to other ones of the plurality of mortar barrels; and a firing control mechanism operatively connected to the proximal end of each of the plurality of mortar barrels and configured to cause a mortar of a given charge to launch from each of the plurality of mortar barrels in a sequence such that the mortar launched from each of the plurality of mortar barrels impacts a kill zone with substantially the same time on target.

2. The multi-barrel mortar launcher of claim 1, wherein the mortar launched from each of the plurality of mortar barrels impacts the kill zone within three seconds of the mortar launched from any other of the plurality of mortar barrels.

3. The multi-barrel mortar launcher of claim 1, wherein each of the plurality of barrels has an elevation angle from 60° to 85° with respect to the horizontal, and wherein each of the plurality of barrels has an azimuth angle from 5° to 24° with respect to a central vertical axis.

4. The multi-barrel mortar launcher of claim 3, wherein the elevation angle is from 60° to 72° with respect to the horizontal, and azimuth angle from 5° to 12°.

5. The multi-barrel mortar launcher of claim 3, wherein the elevation angle is from 70° to 85° with respect to the horizontal, and azimuth angle from 10° to 20°.

6. The multi-barrel mortar launcher of claim 1, wherein the elevation angle and the azimuth angle of each of the plurality of mortar barrels defines a mortar impact area at least 20 meters wide and at least 20 meters long.

7. The multi-barrel mortar launcher of claim 1, wherein mortars fired from each of the plurality of mortar barrels defines an array of mortar blast radii having an impact area of about 100 meters wide×100 meters long, wherein adjacent blast radii partially overlap.

8. The multi-barrel mortar launcher of claim 7, wherein the impact area is between 50 meters and 370 meters from the multi-barrel mortar launcher.

9. The multi-barrel mortar launcher of claim 8, wherein each of the plurality of mortar barrels is configured for 60-mm or 81-mm mortars.

10. The multi-barrel mortar launcher of claim 8, wherein the barrel array is selected from one of a 3×3 array, a 4×4 array, a 3×5 array, a 3×4 array, a 2×3 array, a 2×4 array, a 4×6 array, a 4×8 array, a 3×1 array, and a 2×5 array.

11. The multi-barrel mortar launcher of claim 1, wherein the base is configured as an open-top box secured to the plurality of mortar barrels.

12. The multi-barrel mortar launcher of claim 1, wherein the firing control mechanism comprises a shock tube detonator.

13. A method of mortar defense comprising:

providing a multi-barrel mortar launcher comprising:

a base configured as an open-top box;

a plurality of mortar barrels secured to the base and arranged in a barrel array, each of the plurality of mortar barrels having a closed proximal end adjacent the base and an open distal end directed upward from the base, wherein each of the plurality of barrels has a distinct combination of an elevation angle and an azimuth angle with respect to other ones of the plurality of mortar barrels; and a firing control mechanism operatively connected to the proximal end of each of the plurality of mortar barrels and configured to cause a mortar to launch from each of the plurality of mortar barrels, the firing control mechanism configured to fire the mortar from each of the plurality of barrels in a sequence that results in substantially the same time on target for all of the mortars;

loading one mortar into each of the plurality of mortar barrels;

actuating the firing control mechanism, thereby launching all of the mortars in the sequence, causing an array of blast radii defining a kill zone with a shape corresponding to the barrel array and all of the mortars having substantially the same time-on-target in the kill zone.

14. The method of claim 13, further comprising recessing the multi-barrel mortar launcher into the ground.

15. The method of claim 13, wherein providing the multi-barrel mortar launcher includes selecting the multi-barrel mortar launcher configured for single use.

16. The method of claim 13, wherein the array of blast radii are distributed within the kill zone having a size of at least 50 m×50 m.

17. The method of claim 13, wherein adjacent blast radii overlap in the kill zone.

18. The multi-barrel mortar launcher of claim 1, wherein the distinct combination of the elevation angle and the azimuth angle of each of the plurality of mortar barrels is selected such that blast radii of adjacent mortar impacts overlap in the kill zone.

* * * * *